US007017312B1

(12) United States Patent
Mueller

(10) Patent No.: US 7,017,312 B1
(45) Date of Patent: Mar. 28, 2006

(54) TWO-PIECE CLINCHED PLATE TENSION/COMPRESSION BRACKET

(76) Inventor: Lee W. Mueller, 4132 S. Rainbow Blvd. PBM #247, Las Vegas, NV (US) 89103

( * ) Notice: Subject to any disclaimer, the term of this patent is extended or adjusted under 35 U.S.C. 154(b) by 141 days.

(21) Appl. No.: 10/438,473

(22) Filed: May 13, 2003

Related U.S. Application Data

(63) Continuation-in-part of application No. 09/932,530, filed on Aug. 17, 2001, now Pat. No. 6,560,940.

(60) Provisional application No. 60/226,359, filed on Aug. 18, 2000.

(51) Int. Cl.
*E02D 27/00* (2006.01)

(52) U.S. Cl. ..... 52/295; 52/167.4; 52/293.1; 52/715; 411/536

(58) Field of Classification Search ..... 52/295, 52/167.1, 167.4, 167.8, 272, 274, 293.1, 52/712, 713, 715; 411/536, 916, 917
See application file for complete search history.

(56) References Cited

U.S. PATENT DOCUMENTS

| | | | | |
|---|---|---|---|---|
| 140,526 | A | 7/1873 | Munson, Jr. | |
| 2,780,936 | A | 2/1957 | Hillberg | |
| 3,037,593 | A | 6/1962 | Webster | |
| 3,328,927 | A | 7/1967 | Kates | |
| 3,822,521 | A | 7/1974 | Lucas | |
| 3,871,153 | A | 3/1975 | Birum, Jr. | |
| 3,894,370 | A | 7/1975 | Parazader | |
| 4,078,350 | A | 3/1978 | Ting | |
| 4,603,531 | A | 8/1986 | Nash | |
| 4,631,894 | A | 12/1986 | Jerila | |
| 4,641,726 | A | 2/1987 | Fearon et al. | |
| 4,675,238 | A | 6/1987 | Karoubas | |
| 4,905,444 | A | 3/1990 | Semaan et al. | |
| 5,054,251 | A | 10/1991 | Kemeny | |
| 5,249,404 | A * | 10/1993 | Leek et al. | 52/702 |
| 5,303,520 | A | 4/1994 | Gozdziak | |
| 5,364,214 | A | 11/1994 | Fazekas | |
| 5,375,384 | A | 12/1994 | Wolfson | |
| 5,390,466 | A | 2/1995 | Johnson et al. | |
| 5,619,837 | A | 4/1997 | DiSanto | |
| 5,687,529 | A | 11/1997 | Pickering | |

(Continued)

OTHER PUBLICATIONS

PACO The Engineered Steel Company brochure.
Ultra-Span® Prefabricated Light Gauge Steel Truss System, MiTek® Industries brochure, 1996.

(Continued)

*Primary Examiner*—Daniel P. Stodola
*Assistant Examiner*—Nahid Amiri
(74) *Attorney, Agent, or Firm*—Knobbe Martens Olson & Bear, LLP

(57) ABSTRACT

A two-piece bracket adapted to resist forces in both tension and compression. The tension/compression bracket is formed from stamped, plate steel and is preassembled by clinching or with structural adhesives. The tension/compression bracket provides a range of adjustability of attachment to allow for a limited range of placement of other components that attach to the tension/compression bracket. In one embodiment, the tension/compression bracket includes a resilient resistance to tension forces. The resilient resistance is provided by a high spring constant coil spring. The resilient resistance provides a limited degree of movement under tension. The limited degree of movement is chosen by component selection to be non-damaging.

22 Claims, 12 Drawing Sheets

U.S. PATENT DOCUMENTS

| | | | | |
|---|---|---|---|---|
| 5,706,626 | A | 1/1998 | Mueller | |
| 5,904,025 | A | 5/1999 | Bass et al. | |
| 5,913,788 | A | 6/1999 | Herren | |
| 6,006,487 | A | 12/1999 | Leek | |
| 6,012,256 | A | 1/2000 | Aschheim | |
| 6,058,668 | A | 5/2000 | Herren | |
| 6,327,831 | B1 * | 12/2001 | Leek | 52/698 |
| 6,389,767 | B1 * | 5/2002 | Lucey et al. | 52/295 |
| 6,390,747 | B1 | 5/2002 | Commins | |
| 6,453,634 | B1 * | 9/2002 | Pryor | 52/713 |
| 6,513,290 | B1 * | 2/2003 | Leek | 52/295 |
| 6,550,200 | B1 | 4/2003 | Mueller | |
| 6,625,945 | B1 * | 9/2003 | Commins | 52/293.3 |
| 6,715,258 | B1 * | 4/2004 | Mueller | 52/745.12 |

OTHER PUBLICATIONS

Sadek et al., "Passive Energy Dissipation Devices for Seismic Applications" NISTIR 5923, United Stated Department of Commerce, Technology Administration, National Institute of Standards and Technology, Nov. 1996.
Light Beam System, Low Cost Steel Frame Housing, Light Beam Inc. brochure, Jan. 1997.
Light Beam System, LBN Shear Panel, Light Beam Inc. brochure, Jan. 1997.
SEMCO, Metal Connectors catalog, 1997-1998.
Shear Max™ Panel brochure, 1998.
CeeWal™ Feel the Steel . . . brochure, Oct. 1998.
Strong-Wall™ Shearwall brochure, Simpson Strong-Tie Co., 1999-2000.
Connection Specialists, Inc. brochure.
Z Wall, Strength Where You Need It brochure.

* cited by examiner

TWO-PIECE CLINCHED PLATE TENSION/COMPRESSION BRACKET

RELATED APPLICATIONS

This application is a continuation-in-part of U.S. application Ser. No. 09/932,530 filed Aug. 17, 2001 now U.S. Pat. No. 6,560,940, entitled "TWO-PIECE CLINCHED PLATE TENSION/COMPRESSION BRACKET." This application claims the benefit of U.S. Provisional Application No. 60/226,359 filed Aug. 18, 2000, entitled "TWO-PIECE CLINCHED PLATE TENSION/COMPRESSION BRACKET."

BACKGROUND OF THE INVENTION

1. Field of the Invention

The invention relates to the construction industry and, in particular, concerns a method of interconnecting building members to anchor structures.

2. Description of the Related Art

In typical residential and light industrial/commercial building frame wall construction, load bearing frame walls are comprised of a series of studs and posts that are anchored to the foundation and covered with sheathing material installed over both sides of the frame. Typically, the frame is constructed from a number of vertically extending studs that are positioned between and interconnected with upper and lower plates. The lower plates and/or vertical studs are typically anchored to the foundation in some fashion. The covering material, plywood, sheet rock, siding, plaster, etc. is then attached over the studs.

Natural forces commonly occur that impose vertical and horizontal forces on the structural elements of the buildings. These forces can occur during earth movement in an earthquake and from high wind conditions such as hurricanes, tornadoes, cyclones, or other extreme weather conditions. If these forces exceed the structural capacity of the building, they can cause failures leading to damage to or the collapse of the building with resultant economic loss and potential injuries and loss of life.

A typical method of securing a frame to a foundation is to connect one end of a length of metal strapping to an end of wall stud and to embed the other end in the concrete foundation. Uplift forces acting on the building frame are resisted through the embedded strap. The use of metal strapping is convenient to install, but has strength limitations to inhibit uplift. In particular, the metal strapping is typically attached to a frame member such as a post using relatively few fasteners. Thus, each of the fasteners are subjected to a relatively large fraction of the transferring force, increasing the likelihood of the fastener or its attachment points failing.

Another need in existing construction materials and techniques arises with respect to the vertical loads carried by a building's frame. The gravity weight of a building and its contents direct a vertical load that is typically transferred to and carried by the vertical load bearing studs or posts of the building's frame. These vertical members typically bear at their lower end on a pressure treated mudsill.

A mudsill typically comprises a number of 2×4 pieces of lumber placed directly on a foundation so as to lay on the face defined by the 4" dimension and the longest dimension. A mudsill is also used as a nailing surface along the lower extent of the exterior walls. The inherent structural problem with the mudsill, comprising a wooden member, is that it has less capacity to resist crushing because of the orientation of the grain of the wood. A compressive distortion in the mudsill allows the vertical load-bearing studs to move downwards due to the incident vertical load. Compressive movement of the vertical end studs in a shear panel creates deflection in the walls of the building, weakening the overall structure, providing impetus for cracks to form in the external and interior wall finishings, and potentially concentrating load stresses in unforeseen and damaging ways.

Furthermore, devices that fasten vertical members such as posts to the foundation do so in a substantially rigid manner. In certain force situations, having a substantially rigid and strong interconnection of the post to the foundation may lead to failures at another location.

From the foregoing, it can be appreciated that there is a continuing need for a method and device to continuously secure and anchor a building frame to a foundation. The desired anchoring method should be convenient to install, yet offer strength advantages to the existing use of metal strapping. It would be an additional advantage for the device to be capable of supporting vertical compression loads as well as tension loads to thereby enable the device to transfer loads directly to the foundation. There is a need for an attachment apparatus that permits use of ductile elements so as to allow the attachment apparatus to dissipate a portion of the tension or compression loads, while transferring the rest to the foundation.

SUMMARY OF THE INVENTION

The aforementioned needs are satisfied by one aspect of the present teachings that relates to a device for transferring tension and compression forces incident on a metal vertical support of a building to an anchor bolt extending out of a foundation of the building. The device comprises an attachment member having at least one planar surface that is size to be attached to the metal vertical support of building. The attachment member includes a laterally extending section that extends outward from the planar surface. The device further comprises a load piece that is attached to the attachment member. The load piece includes a mounting section that defines a recess that receives the laterally extending section such that the laterally extending section reinforces the mounting section. The mounting section has an upper and lower surface that are substantially perpendicular to planar surface. The upper and lower surface include openings through which the anchor bolt extend such that the anchor bolt can be coupled to the load piece with the laterally extending section of the attachment member reinforcing the mounting section of the load piece.

In one embodiment, the attachment member is attached to the load piece via clinching. In another embodiment, the attachment member is attached to the load piece via an adhesive. In another embodiment, the attachment member is attached to the load piece via a combination of clinching and adhesive.

In one embodiment, the attachment member is attached to the metal vertical post by a plurality of fasteners such as self-tapping metal screws. In another embodiment, the attachment member is attached to the metal vertical support by an adhesive. In another embodiment, the attachment member is attached to the metal vertical support by a combination of an adhesive and a plurality of fasteners.

In one embodiment, the metal vertical post is formed from steel. In one embodiment, the steel post comprises a steel tube such as a rectangular shaped tube. In one embodiment, one of the sides of the rectangle has a dimension of approximately 3½". In another steel embodiment, the steel post has a cross-sectional shape of a double-C-channel configuration comprising a back-to-back arrangement of two C-channels wherein each C-channel defines a recess within the "C" shape. In one embodiment, the recess defined by the C-channel is dimensioned to allow positioning of the attachment member and the load piece substantially therein.

Another aspect of the present teachings relates to a device for transferring tension and compression forces incident on a metal vertical support of a building to an anchor bolt extending out of a foundation of the building. The device comprises an attachment member having a planar surface that is attachable to the metal vertical support of the building. The attachment member is shaped so as to define a reinforcing section that extends outward from the planar surface. The device further comprises a mounting member that is attached to the attachment member, wherein the mounting member includes a planar surface and is shaped so as to define a mounting section that defines a recess which receives the reinforcing section of the attachment member. The mounting member includes openings so as to permit the anchor bolt to extend therethrough such that when the anchor bolt is mechanically coupled to the mounting section and the planar surface of the attachment member is attached to the metal vertical support of the building, tension and compression forces incident on the metal vertical support of the building can be transmitted to the anchor bolt.

In one embodiment, the attachment member is attached to the mounting member via clinching. In another embodiment, the attachment member is attached to the mounting member via an adhesive. In another embodiment, the attachment member is attached to the mounting member via a combination of clinching and adhesive.

In one embodiment, the attachment member is attached to the metal vertical post by a plurality of fasteners such as self-tapping metal screws. In another embodiment, the attachment member is attached to the metal vertical support by an adhesive. In another embodiment, the attachment member is attached to the metal vertical support by a combination of an adhesive and a plurality of fasteners.

In one embodiment, the metal vertical post is formed from steel. In one steel embodiment, the steel post comprises a steel tube such as a rectangular shaped tube. In one of the rectangular steel tube embodiment, one of the sides of the rectangle has a dimension of approximately 3½".

In another embodiment, the steel post has a cross-sectional shape of a double-C-channel configuration comprising a back-to-back arrangement of two C-channels wherein each C-channel defines a recess within the "C" shape. In one embodiment, the recess defined by the C-channel is dimensioned to allow positioning of the attachment member and the mounting member substantially therein.

These and other objects and advantages will be more apparent from the following description taken in conjunction with the accompanying drawings.

DETAILED DESCRIPTION OF THE PREFERRED EMBODIMENT

Figure 1:
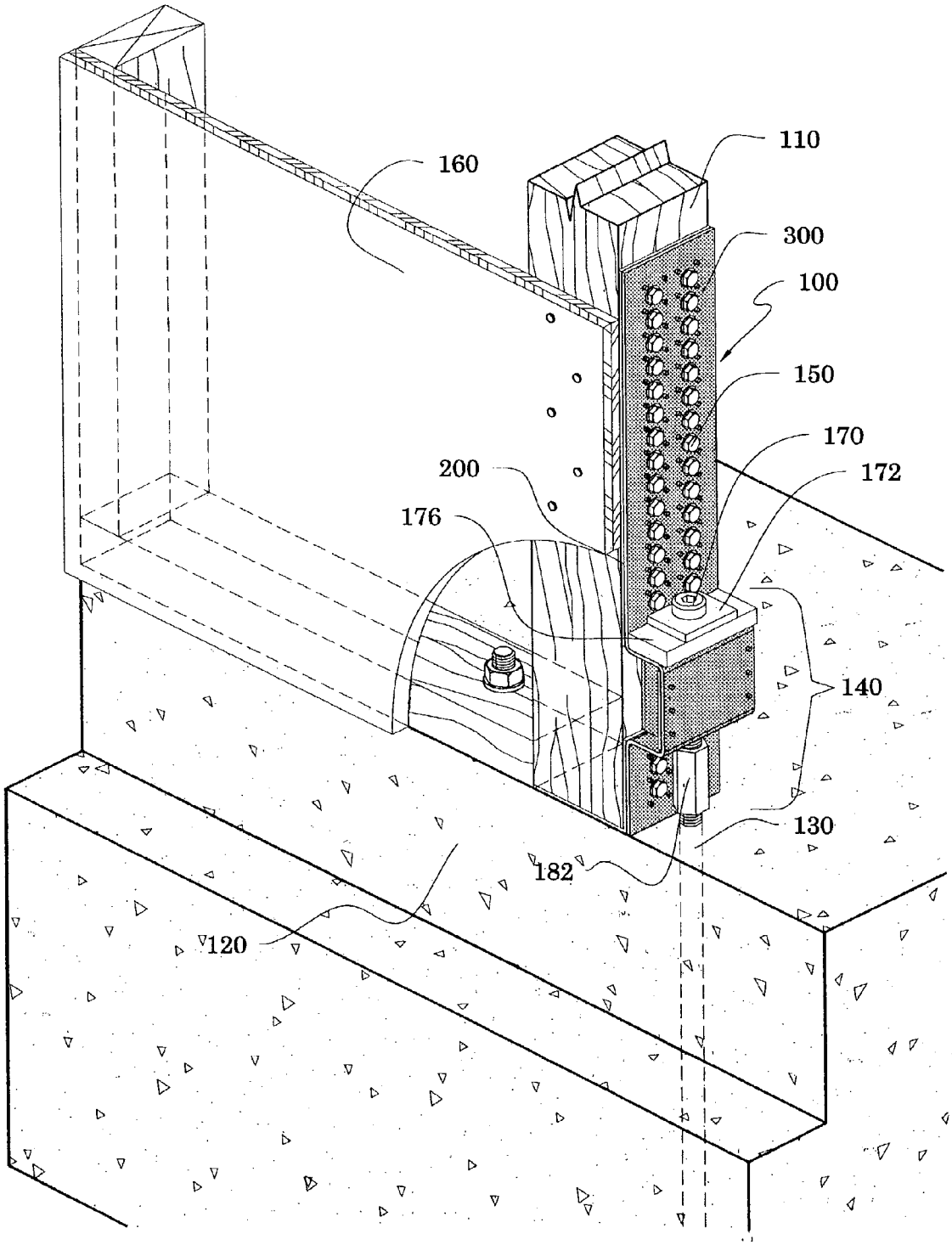
FIG. 1 illustrates a perspective view of a two-piece clinched plate tension/compression bracket interconnecting a post to a foundation so as to transfer tension and compression forces on the post to the foundation.

Reference will now be made to the drawings wherein like numerals refer to like parts throughout. FIG. 1 illustrates one embodiment of a two piece clinched plate tension/compression bracket 100 (referred to as bracket hereinafter) interconnecting an elongate structure member such as a post 110 to a foundation 120. The bracket 100 is attached to the post by a plurality of fasteners such as screws 150 or bolts in a substantially rigid manner. The bracket is further attached to an anchor member such as an anchor bolt 130 by a connecting assembly 140. As will become evident with description of individual parts below, the bracket 100 is adapted to transfer tension and compression forces on the post 110 to the foundation 120. In one embodiment, the bracket 100 is sized to allow finishing materials such a wall panels 160 to be installed.

Figure 2A:
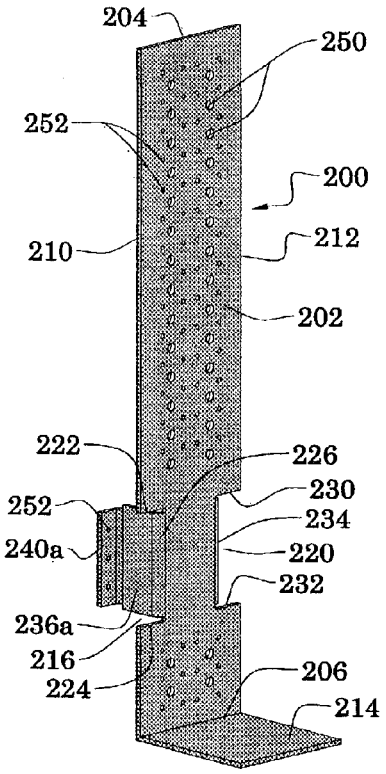
FIG. 2A is a perspective view illustrating an inner plate of the bracket of FIG. 1.
Figure 2B:
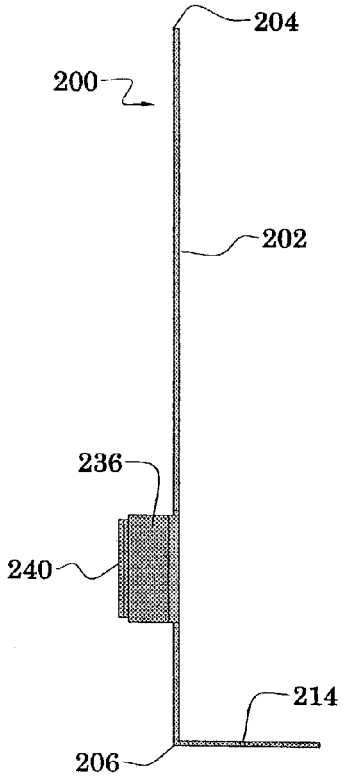
FIG. 2B is a side view of the inner plate of FIG. 2A.

As shown in FIG. 1, the bracket 100 comprises an inner plate 200 interposed between the post 110 and an outer plate 300. The inner plate 200 is illustrated in FIGS. 2A to 2D. As shown in FIGS. 2A and 2B, the inner plate 200 comprises a rectangular shaped upper section 202 that extends lengthwise in a first direction from a first end 204 to a second end 206. The upper section 202 further comprises a first side 210 and a second side 212, such that the first and second sides 210 and 212 are substantially parallel and first and second ends 204 and 206 are substantially parallel. Attached to the second end 206 is a rectangular shaped base section 214 that extends in a second direction that is substantially perpendicular to the first direction. The base section 214 is oriented such that its attachment edge coincides with the edge on the second end 206. In the preferred embodiment, the inner plate 200 is made of a single contiguous member that is bent into the shape shown in FIGS. 2A–2D. Thus, a plane defined by the upper section 202 is substantially perpendicular to a plane defined by the base section 214. The upper section 202 engages one of the sides of the post 110 in a manner described below. The base section 214 engages the bottom of the post 110 in a manner described below so as to be interposed between the post 110 and the foundation 120.

The upper section 202 of the inner plate 200 defines a first recess 216 and a second recess 220. The first recess 216 is located along the first side 210, approximately ¾ of the way from the first end 204 to the second end 206. The first recess 216 is defined by a first edge 222, a second edge 224, and a third edge 226 arranged such that the first and second edges 222 and 224 are substantially parallel to the first and second ends 204 and 206, and the third edge 226 is substantially parallel to the first side 210. The second edge 224 is between the first edge 222 and the second end 206, and the third edge 226 is between the first side 210 and the second side 212.

The second recess 220 is located along the second side 212, and is a substantial mirror image of the first recess about a plane substantially perpendicular to the first section and substantially half way between the first and second sides 210 and 212. Similar to the first recess 216, the second recess 220 is defined by a first edge 230, a second edge 232, and a third edge 234. The second edge 232 is parallel to, and between the first edge 230 and the second end 206. The third edge 234 is parallel to, and between the second side 212 and the first side 210.

Figure 2C:
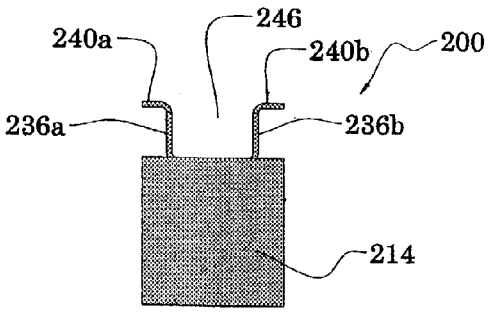
FIG. 2C is a plan view of the inner plate of FIG. 2A.

As seen FIGS. 2A and 2C, extending from the third edge 226 of the first recess 216 is a coupling section 236. The coupling section 236 is a rectangular shaped member that extends in a third direction that is substantially perpendicular to the first direction specified above, and substantially opposite the second direction also specified above. A plane defined by the coupling section 236 is substantially perpendicular to the plane defined by the upper section 202, and also substantially perpendicular to the plane defined by the base section 214.

Extending from the coupling section 236*a* is a flange section 240*a*. The flange section 240*a* is a rectangular shaped member that extends towards the first side 210. A plane defined by the flange section 240*a* is substantially perpendicular to the plane defined by the coupling section 236*a* and substantially parallel to the plane defined by the upper section 202.

In a similar manner, extending from the third edge 234 of the second recess 220 is a coupling section 236*b* and a flange section 240*b*, wherein the coupling and flange sections 236*b*, 240*b* are substantial mirror images of the coupling and flange sections 236*a* and 240*b*, respectively, about the plane substantially perpendicular to the upper section 202 and substantially half way between the first and second sides 210 and 212. Thus the coupling section 236*b* extends in the third direction, and is substantially parallel to the coupling section 236*a*. The flange section 240*b* extends from the coupling section 236*b* towards the second side 212.

The coupling sections 236*a*, 236*b* and the flange sections 240*a*, 240*b* have dimensions along the first direction that are less than the separation distance between the first and second edges 222 and 224 of the first recess 216 by approximate an amount necessary to cut out the coupling sections 236*a*, 236*b* from the first section 202. The flange sections 240*a*, 240*b* sized such that when the inner plate 200 is viewed facing the first section, as in FIG. 2D, the flange sections 240*a*, 240*b* are superimposed substantially within the first recess 216.

The coupling sections 236*a*, 236*b* and the flange section 240*a*, 204*b*, when viewed in cross section along the first direction, extend in two dimensions, so as to resist buckling when subjected to forces along (and opposite) the first direction. The coupling sections 236*a*, 236*b* and flange sections 240*a*, 240*b* are sized to fit inside a portion of the outer plate 300 in a manner described below. In particular, the coupling sections 236*a*, 236*b* and the upper section 202 define an opening 246, as seen in FIG. 2C, through which a bolt extends in the first direction so as to interconnect the bracket 100 to the foundation 120 in a manner described below.

The upper section 202 of the inner plate 200 further defines a plurality of fastener holes 250 that permit the screws 150 (FIG. 1) to extend therethrough so as to engage the post 110. The fastener holes 250 are arranged throughout the upper section 202 in a selected manner so as to distribute the forces being transferred throughout the upper section 202.

Figure 2D:
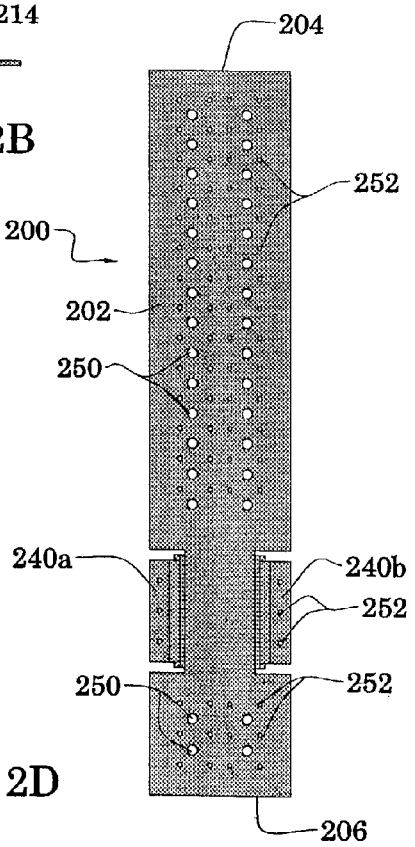
FIG. 2D is a front view of the inner plate of FIG. 2A.

The upper section of the inner plate 200 further defines a plurality of clinch holes 252 that are sized to receive a plurality of clinches on the outer plate 300 described below. As shown in FIGS. 2A and 2D, the flange sections 240*a*, 240*b* also define a plurality of clinch holes 252 that are sized to receive clinches on the outer plate 300. The clinch holes 252 are arranged throughout the upper and flange sections 202, 240*a*, and 240*b* in a selected manner so as to mechanically couple the inner plate 200 to the outer plate 300 in a substantially rigid manner such that transfer of forces is further improved.

In one embodiment, the inner plate 200 is formed from an ⅛" thick steel plate. The upper section 202 has dimensions of approximately 1'–6"×3½". The first and second recesses 216 and 220 are approximately ¾" deep (distance between the first, second sides 210, 212 and the respective third edges 226, 234), and approximately 3" high (distance between respective first, second edges 222, 224 and 230, 232). The first edges 222 and 230 of the first and second recesses 216 and 220 are separated from the first end 204 by approximately 1'. Each of the coupling sections 236*a*, 236*b* has dimensions of approximately 1⅜" in the third direction, and approximately 2¼" in the first direction. Each of the flange sections 240*a*, 240*b* has dimensions of approximately ¾" towards first and second sides 210 and 212, and approximately 2½" in the first direction. The base section 214 extends approximately 3⅝" in the second direction, and is approximately 3½" wide. The fastener holes 250 are sized to have a diameter of approximately ¼".

Figure 3A:
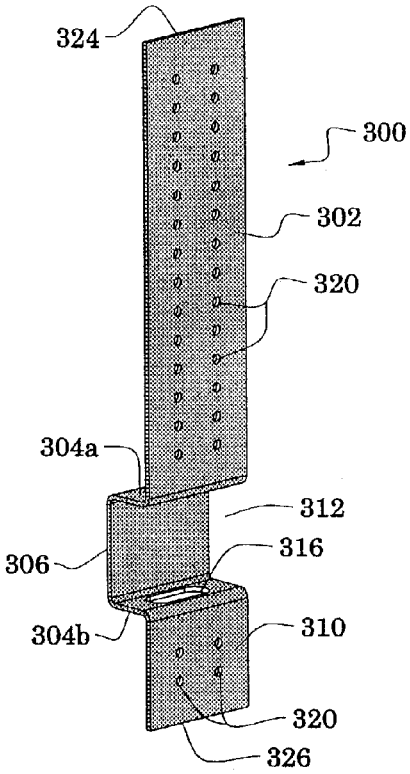
FIG. 3A is a perspective view illustrating an outer plate of the bracket of FIG. 1.
Figure 3B:
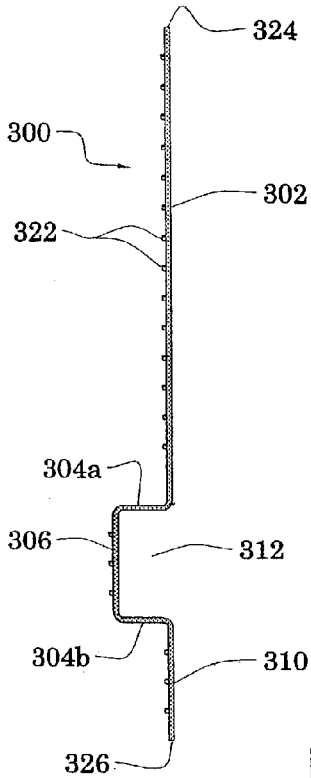
FIG. 3B is a side view of the outer plate of FIG. 3A.

FIGS. 3A to 3D illustrate the outer plate 300 that is positioned adjacent the inner plate 200 as shown in FIG. 1. As shown in FIGS. 3A and 3B, the outer plate 300 comprises a series of rectangular shaped sections connected in series, edges to edges, extending in first, second, and third directions specified above. Specifically, the second and third directions are substantially opposite to each other, and substantially perpendicular to the first direction. The outer plate 300 comprises a first end 324 from which an upper section 302 extends lengthwise in the first direction. A first offset section 304*a* extends in the third direction from the end of the upper section 302. A recessed section 306 extends in the first direction from the end of the second section 304. A second offset section 304*b* extends in the second direction from the third section 306. A lower section 310 extends in the first direction from the second section 304*b*. The end of the lower section 310 defines a second end 326 of the outer plate 300.

The upper section 302 and the lower section 310 are substantially coplanar, and substantially parallel to the recessed section 306. The first and second offset sections

304*a*, 304*b* are substantially parallel with each other, and substantially perpendicular to the first section 302. The second and fourth sections 304 and 308 have substantially similar dimensions.

The offset sections 304*a*, 304*b* and the recessed section 306 define a recess 312 that is located approximately ¾ of the way from the first end 324 to the second end 326. The recess 312 is sized to receive the coupling sections 236*a*, 236*b* and the flange sections 240*a*, 240*b* of the inner plate 200. The upper and lower sections 302 and 310 are sized to be engaged with the upper section 202 of the inner plate 200 in a manner described below.

The upper, lower and recessed sections 302, 306, and 310 comprise a plurality of clinches 322 that are sized and arranged to be secured to the clinch holes 252 defined by the inner plate 200. In particular, the clinches 322 on the upper section 302 of the outer plate 300 are secured to the clinch holes 252 defined by the upper portion of the upper section 202 of the inner plate 200. The clinches 322 on the lower section 310 of the outer plate 300 are secured to the clinch holes 252 defined by the lower portion of the upper section 202 of the inner plate 200. The clinches 322 on the recessed section 306 of the outer plate 300 are secured to the clinch holes 252 defined by the flange sections 240*a* and 240*b* of the inner plate 200. The plurality of clinches described above secure the outer plate 300 to the inner plate 200 in a substantially rigid manner so as to improve the force transferring capacity of the bracket 100. The clinching of the outer plate 300 to the inner plate 200 is preferably performed at a factory.

The upper and lower sections 302 and 310 of the outer plate 300 define a plurality of fastener holes 320 that permit fasteners such as screws 150 (FIG. 1) to extend therethrough. The holes 320 are sized and arranged in a selected manner so as to substantially match the fastener holes 250 defined by the inner plate 200. The holes 320 and the holes 250 permit the screws 150 to pass through so as to secure the bracket 100 to the post 110. It will be appreciated that distribution of the fastener holes 320, 250 and the clinches 322, 252 throughout the bracket 100 permit the forces being transferred by the bracket 100 to be distributed so as to reduce localization of forces that can lead to structural failures.

Figure 3C:
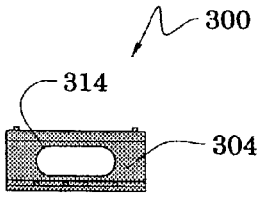
FIG. 3C is a plan view of the outer plate of FIG. 3A.
Figure 3D:
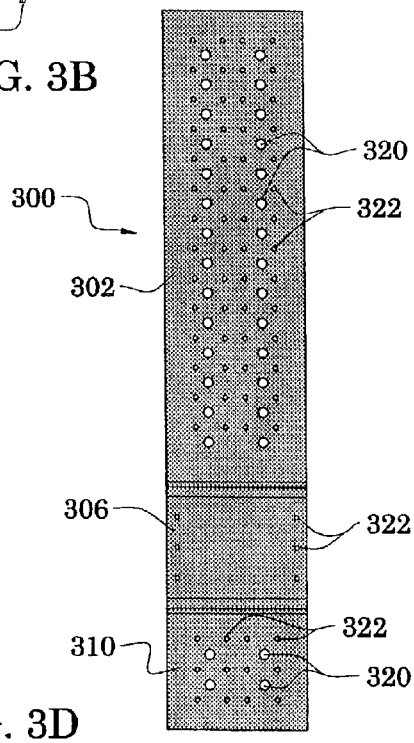
FIG. 3D is a front view of the outer plate of FIG. 3A.

As shown in FIGS. 3A and 3C, the first and second offset sections 304*a*, 304*b* of the outer plate 300 defines a first slot 314 and a second slot 316, respectively. The first and second slots 314 and 316 extend along a fourth direction that is substantially perpendicular to both first and second (and thus third) directions. The slots 314, 316 permit a hold down bolt 170 (FIG. 1) to extend therethrough so as to interconnect the bracket 100 to the foundation 120 in a manner described below. The slots 314, 316 permit limited adjustment in positioning of the bracket 100 to compensate for a possibly misaligned anchor bolt 130.

In one embodiment, the outer plate 300 is formed from an ⅛" thick steel plate. The width of the outer plate 300 along the fourth direction is approximately 3½, thus defining one of the dimensions of the five rectangular sections 302, 304, 306, 308, 310. Thus, the other dimension of the five sections 302, 304, 306, 308, 310 are, respectively, approximately 1', 1½", 3", 1½", 3". The slots 314, 316 are approximately 2" long end to end, and approximately ⅝" wide.

As shown in FIG. 1, when the inner plate 200 is attached to the outer plate 300, the coupling and flange sections 236*a*, 236*b* of the inner plate and the recess 246 defined therebetween are positioned within the recess 312 defined by the outer plate 300. The coupling sections 236*a*, 236*b* and flange sections 240*a*, 240*b* extend in third and fourth directions, respectively, both of which are substantially perpendicular to the first direction so as to resist buckling under forces directed parallel to the first direction. Portions of the recess 246 of the inner plate 200 and the recess 312 of the outer plate 300 overlap to define a space interposed between the slots 314 and 316, so as to permit the hold down bolt 170 to extend through.

Figure 4:
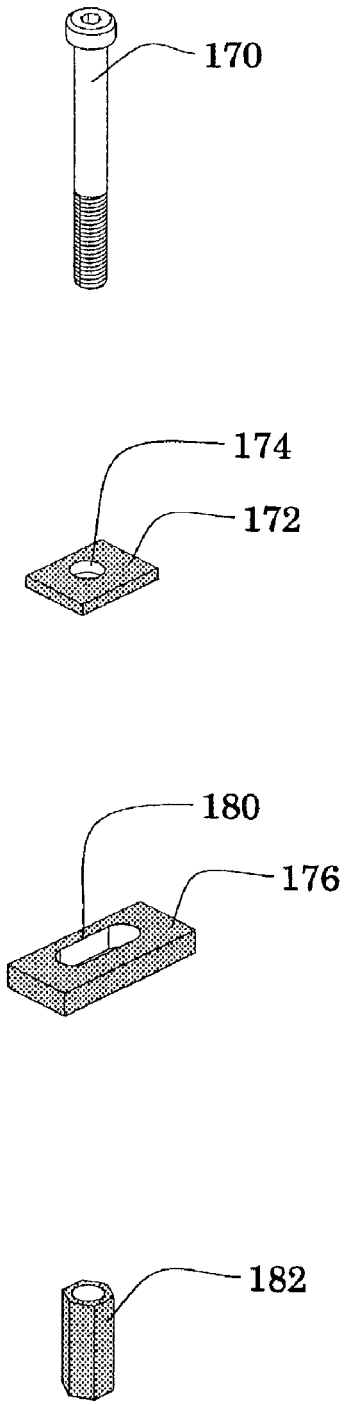
FIG. 4 illustrates a hold down bolt, a washer plate, a slotted bearing plate, and a coupling nut that are used to interconnect the bracket to the foundation.

As shown in FIG. 1, the bracket 100 is interconnected to the foundation by the connecting assembly 140 that comprises the hold down bolt 170, a washer plate 172, a slotted bearing plate 176, and a coupling nut 182. These parts that form the connecting assembly 140 are illustrated in FIG. 4. The washer plate 172 is a rectangular shaped plate that defines a hole 174 through which the hold down bolt 170 passes through. The washer plate 172 distributes the load from the head of the hold down bolt 170 to the slotted bearing plate 176 that is positioned adjacent the washer plate 172.

The slotted bearing plate 176 is a substantially stiff rectangular shaped plate that defines a slot 180 substantially centered that extends lengthwise. The bearing plate 176 is interposed between the washer plate 172 and the second section 304 (FIG. 3B) of the outer plate 300, and is sized similar to the second section. When the post 110 is under tension, the upward force is transferred to the bracket 100, and then to the hold down bolt 170 via the bearing plate 176 and the washer plate 172. The bearing plate 176, being in contact with the second section 304 face to face, distributes the contact force therebetween so as to inhibit deformation of the bracket 100.

The slot 180 defined by the bearing plate 176 extends along the fourth direction specified above so as to provide limited adjustment of the positioning of the bracket relative to the anchor bolt 130. The connecting assembly 140 further comprises a coupling nut 182 that mechanically couples the threaded end of the hold down bolt 170 to the threaded end of the anchor bolt 130 that protrudes from the foundation 120.

In one embodiment, the hold down bolt 170 is a ⅝"×5¼" bolt. The washer plate 172 is an approximately ¼" thick steel plate with dimensions of approximately 2"×1½". The hole 174 is sized to have a diameter of approximately 11/16", and its center is located at the substantial center lengthwise, and approximately ⅝" from one of the long sides so as to be off centered widthwise. The slotted bearing plate 176 is an approximately ½" thick steel plate with dimensions of approximately 3½"×1½". The slot 180 is approximately 2" long from end to end, and is approximately 11/16" wide. The center of the slot 180 is substantially centered lengthwise, and is located approximately ⅝" from one of the long sides so as to be off centered widthwise. The coupling nut 182 is an approximately 2" long nut that is threaded to receive ⅝" bolts from both ends so as to provide mechanical coupling between the two bolts.

To interconnect the post 110 to the foundation 120, the bracket 100 (comprising the factory clinched inner and outer plates 200 and 300) is positioned so as to be interposed between the post 110 and the anchor bolt 130. The base section 214 is interposed between the post 110 and the foundation 120 to thereby protect the bottom of the post which allows for the use of non-pressure treated wood in some applications. The first section 202 of the inner plate 200 is in engagement lengthwise with the lower portion of the post 110, and the second section 204 is interposed between the bottom of the post 110 and the foundation 120. As such, the first direction specified above is downward.

The bracket 100 is attached to the post by a plurality of screws 150 that extend through the holes 320 of the outer plate 300 and the holes 250 of the inner plate 200 that are described above. In one embodiment, the screws 150 are ¼"×3" wood screws.

As shown in FIG. 1, the bracket 100 is interconnected to the foundation 120 by extending the hold down bolt 170 through the hole 174 on the washer plate 172, through the slot 180 on the bearing plate 176, through the slot 314 on the first offset section 304 (FIGS. 3A and 3C) of the outer plate 300, through the space defined by overlapping of the recesses 246 and 312, through the slot 316 of the second offset section 304*b* of the outer plate 300, so as to be received by one end of the coupling nut 182. The other end of the coupling nut 182 receives the threaded end of the anchor bolt 130 so as to be interconnected to the hold down bolt 170.

When a structure to which the post 110 is attached to experiences an uplifting force, the post experiences a tension force that can, if unmitigated, separate the post 110 from the foundation 120. The bracket 100 resists such an uplifting force by transferring the tension force from the post 110 to the foundation 120 via the connecting assembly 140. In particular, the hold down bolt 170 interconnects the bracket 100 to the anchor bolt 130 via the buckling resistant portion of the bracket 100 so as to transfer the tension forces effectively.

Figure 5:
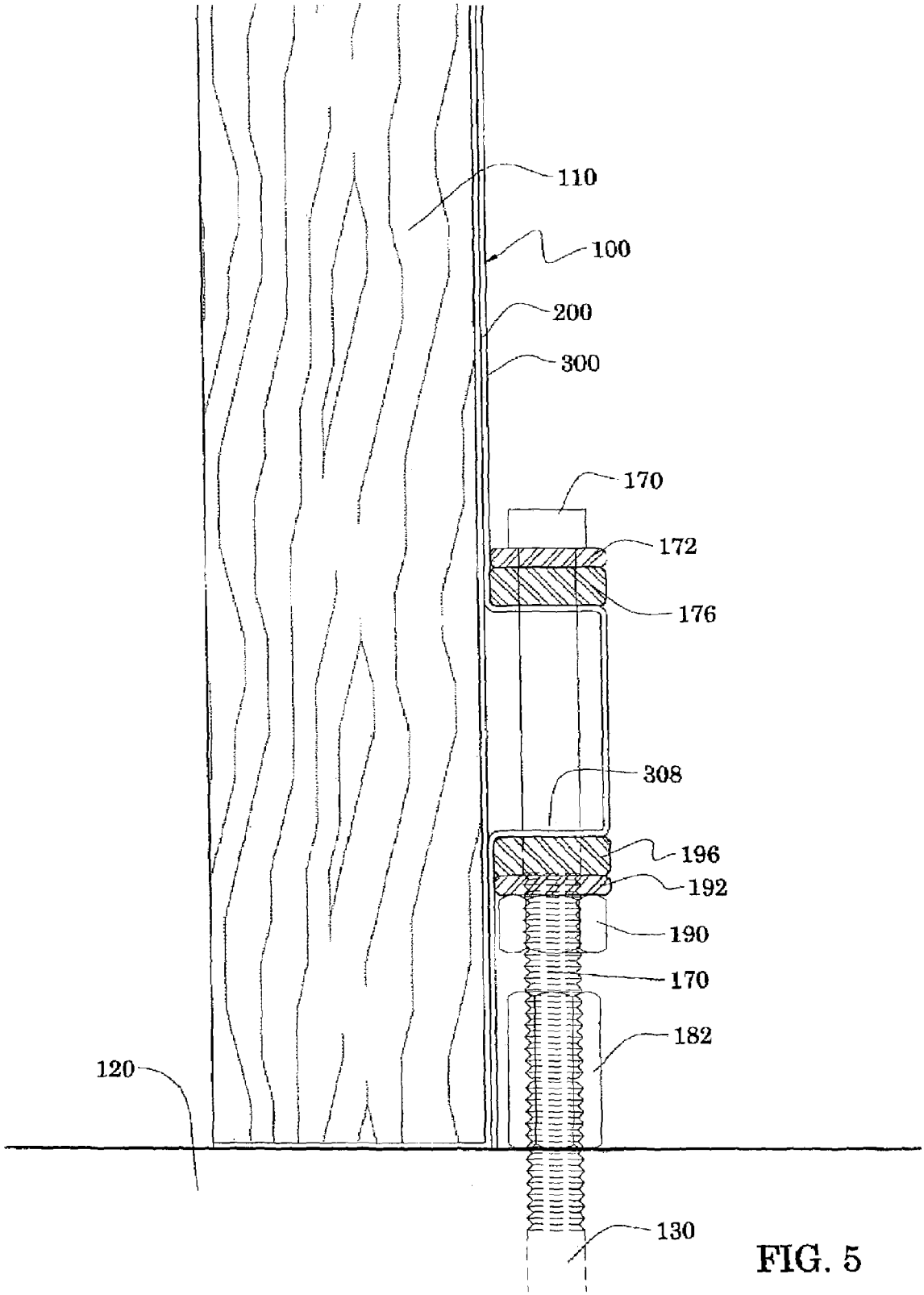
FIG. 5 illustrate an alternate embodiment of the bracket wherein an additional bearing plate enables the bracket to transfer portion of the downward compression force to the foundation.

FIG. 5 illustrates another embodiment of the invention wherein an additional bearing plate 196 and a washer plate 192 are positioned below the lower offset section 304*b* of the outer plate 300. In one embodiment, the bearing plate 196, interposed between the lower offset section 304*b* and the washer plate 192, is similar to the bearing plate 176 described above. The washer plate 192 is also similar to the washer plate 172 described above. The washer plate 192 and the bearing plate 196 are secured in place adjacent the lower offset section 304*b* by a nut 190 that is sized to receive the bolt 170. In one embodiment, the inner and outer plates 200, 300 may have their respective recesses 246, 312 located higher to accommodate the extra vertical space occupied by the additional bearing plate 196 and washer plate 192. Accordingly, the bolt 170 may be longer. The bolt 170 is interconnected to the anchor bolt 130 by the coupling nut 182.

The bearing plate 196 permits portion of a downward compression force on the post 110 to be transferred to the anchor bolt 130 via the hold down bolt 170. As such, the bracket 100 and the connecting assembly provides relief to the post 110 when the post 110 is subjected to a compressive force.

Figure 6:
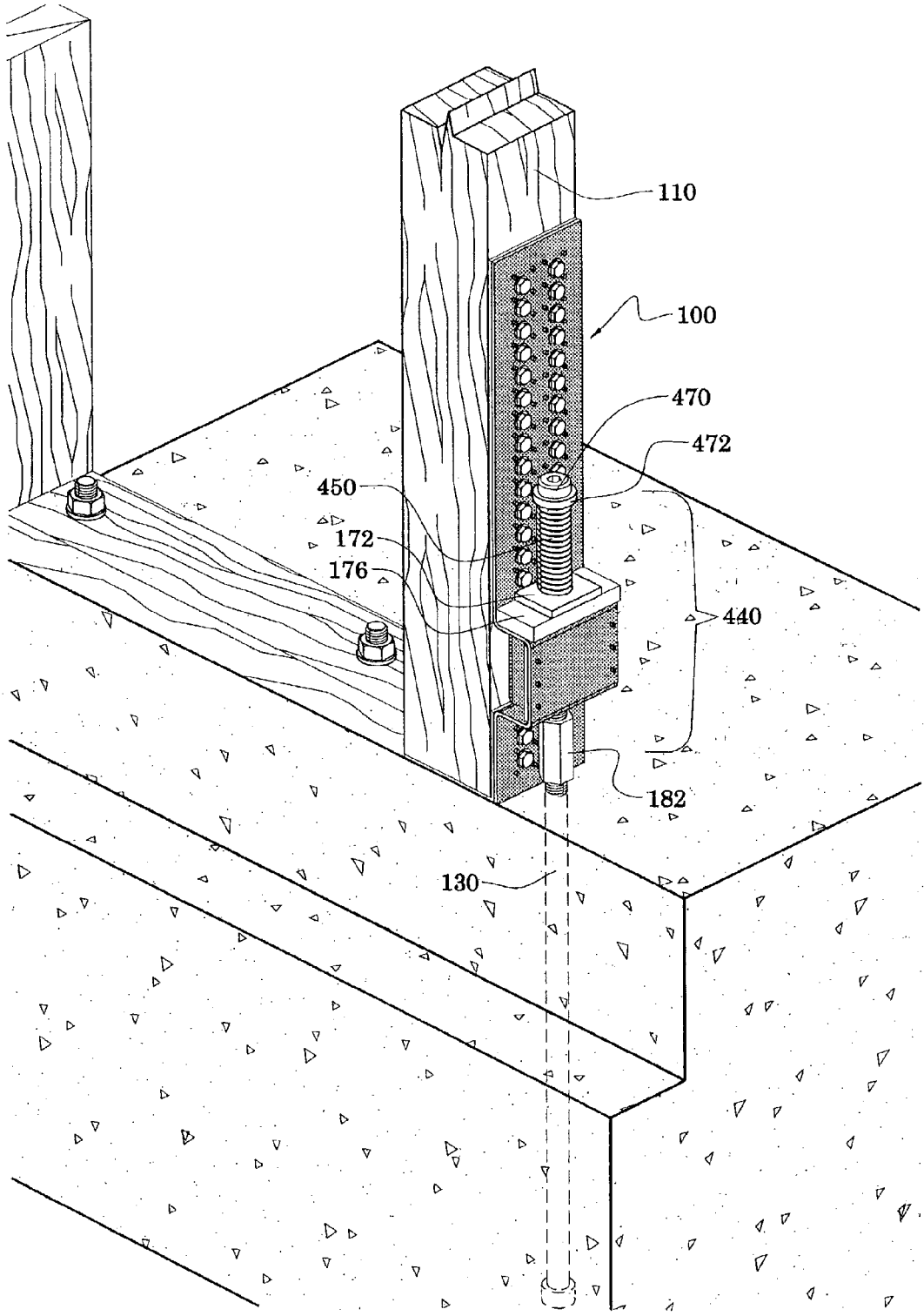
FIG. 6 illustrates another embodiment of the invention wherein a spring couples the bracket to the foundation so as to provide ductility when the post experiences an uplifting force.

Another embodiment of the invention is illustrated in FIG. 6, wherein a connecting assembly 440 comprises a spring 450 to provide a limited vertical movement when the post 110 experiences a tension force. The bracket 100 is substantially similar to that described above in reference to FIGS. 1 to 3, as are the washer plate 172 and the bearing plate 176 described above in reference to FIGS. 1 and 4.

In this embodiment, the spring is positioned above the washer plate 172, and is secured in place by a bolt 470 that extends through a washer 472, through the spring 450, through the washer plate 172 and the parts below it as described above in reference to FIG. 1, so as to be attached to the anchor bolt 182. Thus, one end of the spring 450 is attached to the bearing plate 176 (via the washer plate 172), and the other end of the spring 450 is attached to the foundation 120 via the hold down bolt 470 and the anchor bolt 130, so as to provide spring coupling between the foundation 120 and the bearing plate 176.

In an uplifting force situation, the spring 450, captured by the washer 472 and the washer plate 172, compresses as the bearing plate 176 moves upwards relative to the head of the bolt 470 (and thus the foundation). This ductility provided by the spring 470 dissipates at least a portion of the uplifting force. It will be appreciated that the connecting assembly 440 illustrated in FIG. 6 may also be adapted with additional bearing plate and washer plate as depicted in FIG. 5 to provide transferring of compression forces to the foundation in a manner described above.

In one embodiment, the bolt 470 is a ⅝"×8½" bolt. The washer 472 is a ¼" thick washer adapted to receive a ⅝" thread bolt. The spring 450 is wound from an ⅛" spring steel into a coil that is approximately 3" long and ¾" wide.

As will be understood, the bracket 100 can also be modified for use to interconnect vertical structures on separate floors. Two such brackets can be positioned adjacent each other with a bolt or fastener extending therebetween so thereby interconnect two vertical posts on adjacent floors.

FIGS. 7–12 now illustrate another aspect of the present teachings, wherein brackets functionally similar to that described above may be used in conjunction with various forms of metal studs or posts. It will be understood that for the purpose of description herein, the words "studs" and "posts" may be used interchangeably, and such usage is in no way intended to limit the scope of the present teachings. As described below, some of the bracket's components may be adapted to be used with such metal posts.

Figure 7:
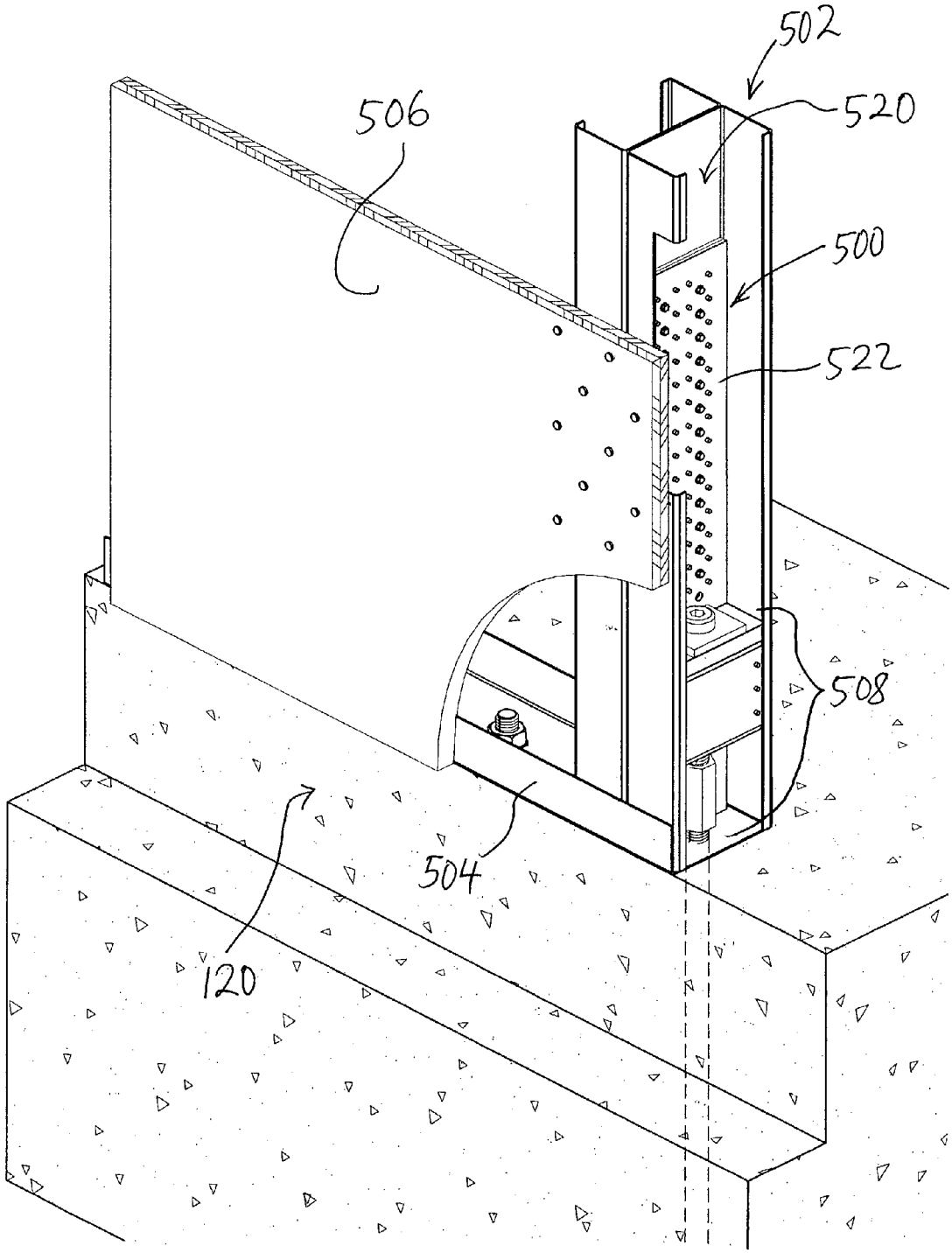
FIG. 7 illustrates a perspective view of a bracket interconnecting a double-C channel metal post to a foundation so as to transfer tension and compression forces on the post to the foundation.
Figure 8A:
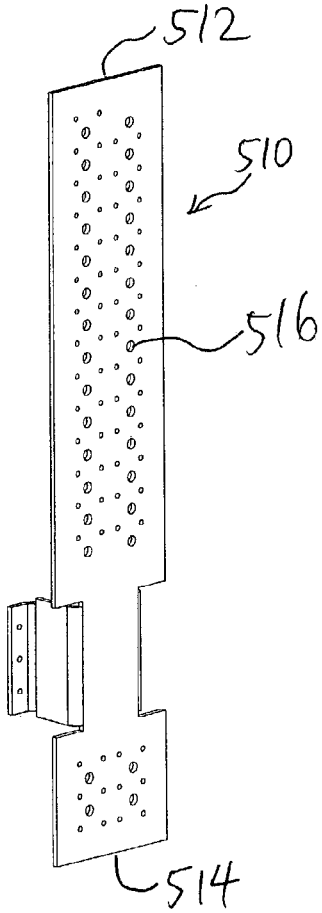
FIGS. 8A–8D illustrate various views of an inner plate of the bracket adapted for use with the metal post.
Figure 8B:
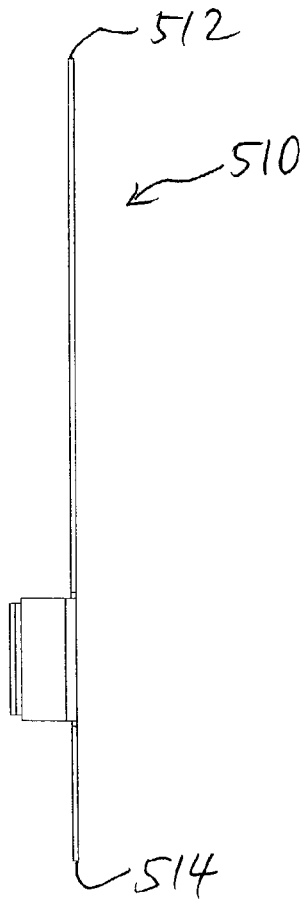
Figure 8C:
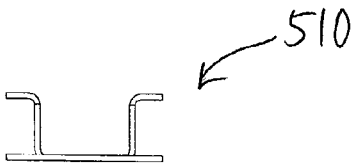
Figure 8D:
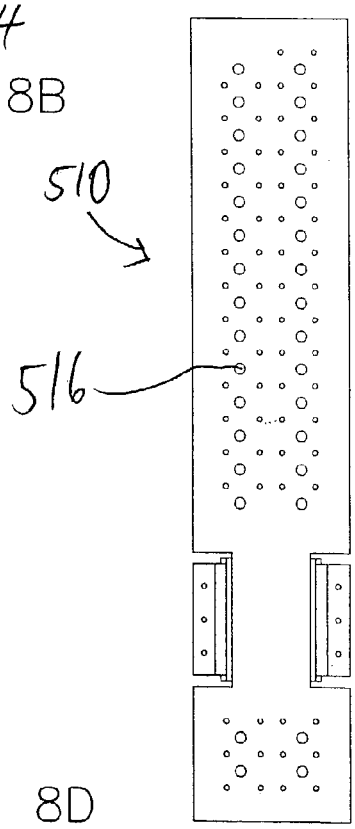

FIG. 7 illustrates a bracket 500 interconnecting a metal post 502 to the foundation 120. In particular, a connecting assembly 508 mechanically couples the bracket 500 to a bolt embedded in the foundation in a manner similar to that described above in reference to the connecting assembly 140 of FIG. 1. The metal post 502 illustrated in FIG. 7 comprises a double-C-channel stud that defines a recess 520. The bracket 500 is positioned within the recess 520 and secured to the C-channel. The bracket 500 may be secured to the C-channels by a plurality of fasteners, by a structural adhesive, or some combination thereof. The fasteners may include, but not limited to, screws, bolts, or clinches.

As shown in FIG. 7, the bottom end of the vertical metal post 502 is typically positioned within a recess defined by a horizontally extending metal track 504. A sheathing 506 attached to the vertical posts (one post 502 shown; others not shown) provides sheathing functionality as well as diaphragm shear resistance for lateral displacement of the assembled wall. In one embodiment, the sheathing 506 may comprise a wood panel, a light gage sheet of steel, or any other appropriate sheathing material or form.

As previously described, the bracket comprises an inner plate and an outer plate. FIGS. 8A–D illustrates various views of an inner plate 510 that is adapted to be used with metal posts. The inner plate 510 defines a first end 512 and a second end 514 in a manner similar to that described above in reference to FIGS. 2A–D. Whereas the inner plate 200 (of FIGS. 2A–D) included a base section 214 to protect the end of a wooden post 110, the inner plate 510 here does not have such a base section. Such a base section may be omitted when the bracket is being used with a metal post, because the metal post typically does not require its end to be protected in a manner similar to the wooden post. In certain embodiments, an outer plate described above in reference to FIGS. 3A–D may be used in conjunction with the inner plate 510.

Figure 9:
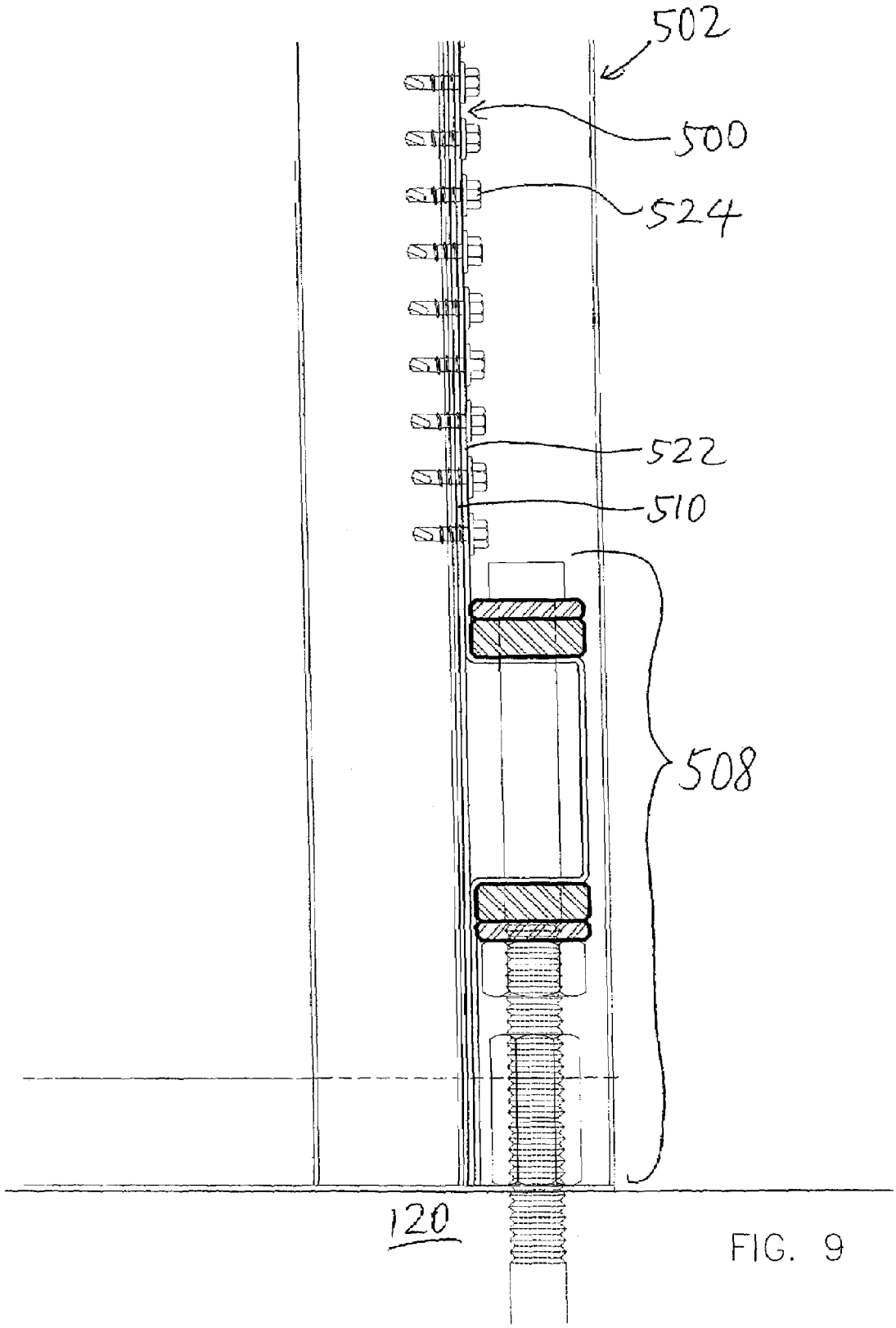
FIG. 9 illustrates a side view of the interconnecting arrangement of FIG. 7.

FIG. 9 illustrates a side view of the interconnection of the metal post 502 to the foundation 120 via the connecting assembly 508. In certain embodiments, the connecting assembly 508 is generally similar to the connecting assembly 140 described above in reference to FIG. 1. As previously described and also shown in FIG. 7, the inner plate 510 and an outer plate 522 may be secured to each other by clinching. In certain embodiments, the inner and outer plates 510 and 522 may also be joined by an adhesive adapted for structural application. Such adhesive joint may be reinforced by clinching.

In FIG. 9, the bracket 500 is shown to be secured to the metal post 502 by a plurality of fasteners 524. In certain embodiments, the fasteners 524 comprise self-tapping screws adapted for metal use. Thus to install the bracket 500 to the post, the screws can extend through a plurality of pre-existing holes (516 in FIGS. 8A and D) on the bracket and installed the post 502 by some driving means.

In certain embodiments, the engagement surface between the bracket 500 and the metal post 502 may be joined by an adhesive adapted for structural application. Such joint may be reinforced by fasteners 524. In certain embodiments, the use of an adhesive may reduce the number of fasteners used.

Figure 10:
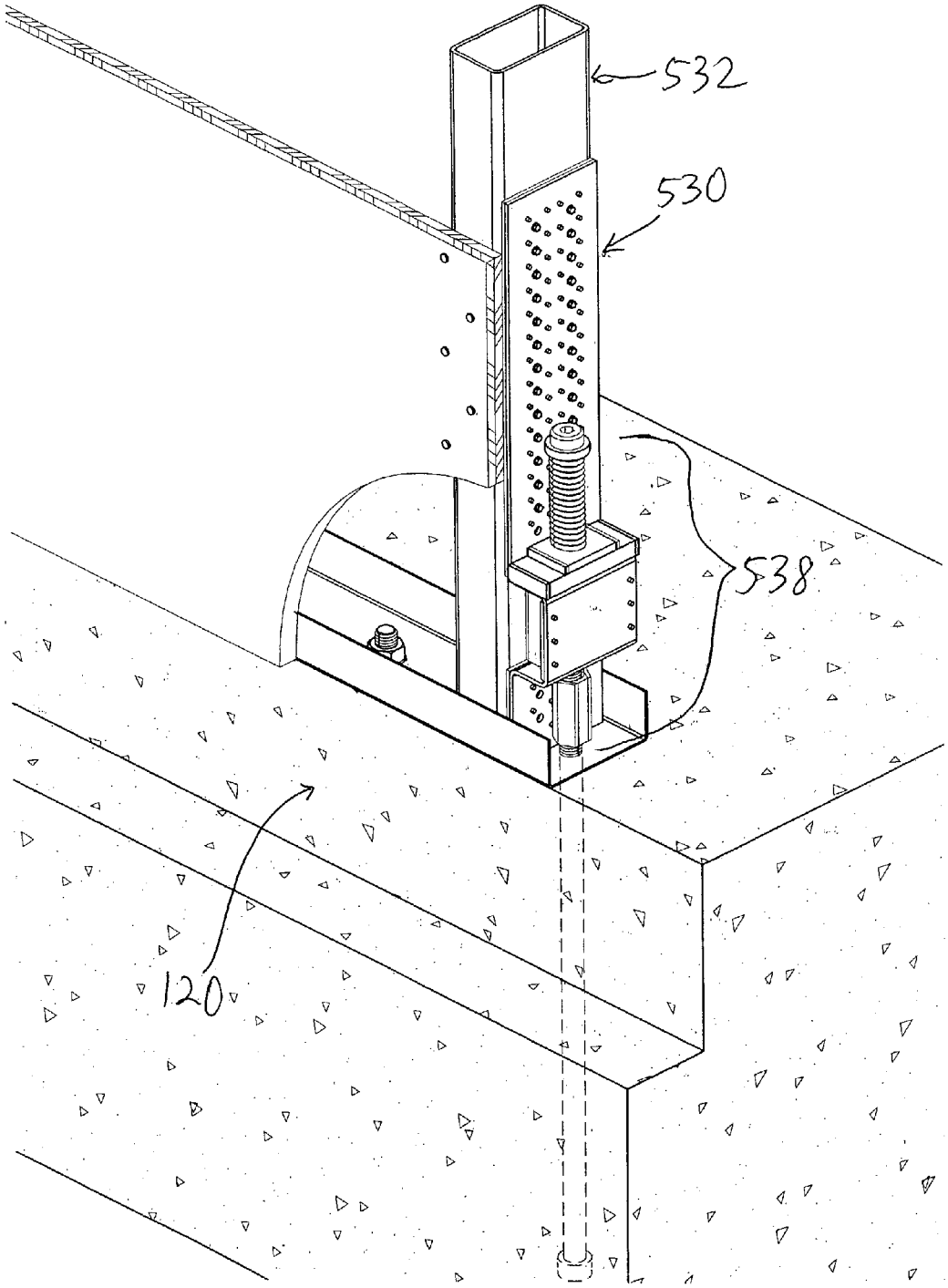
FIG. 10 illustrates a perspective view of a bracket interconnecting a rectangular metal tube post to a foundation so as to transfer tension and compression forces on the post to the foundation.

FIG. 10 illustrates another interconnection of another metal post 532 to the foundation 120 by a bracket 530 employing a connecting assembly 538. The connecting assembly 538 may be similar to the connecting assembly 440 described above in reference to FIG. 6. Inner and outer plates that form the bracket 530 may be similar to those described above in reference to FIGS. 7–9. The metal post 532 illustrated in FIG. 10 comprises a metal tube having a rectangular cross sectional shape.

As is generally understood, metal posts such as the rectangular tube 532 and the double-C-channel 502 provide structural strength for many building applications. It will be appreciated that any other forms and shapes of the metal post may be used in conjunction with the brackets described herein without departing from the spirit of the present teachings. It will also be appreciated that depictions of the connecting assembly 508 with the double-C-channel post 502 and the connecting assembly 538 with the rectangular tube post 532 are in no way intended to limit the application of the various embodiments of the connecting assemblies to particular posts. Thus, the connecting assembly 508 could be used with any of the metal posts described or suggested herein. Similarly, the connecting assembly 538 may also be used with any of the metal posts described or suggested herein.

Figure 11:
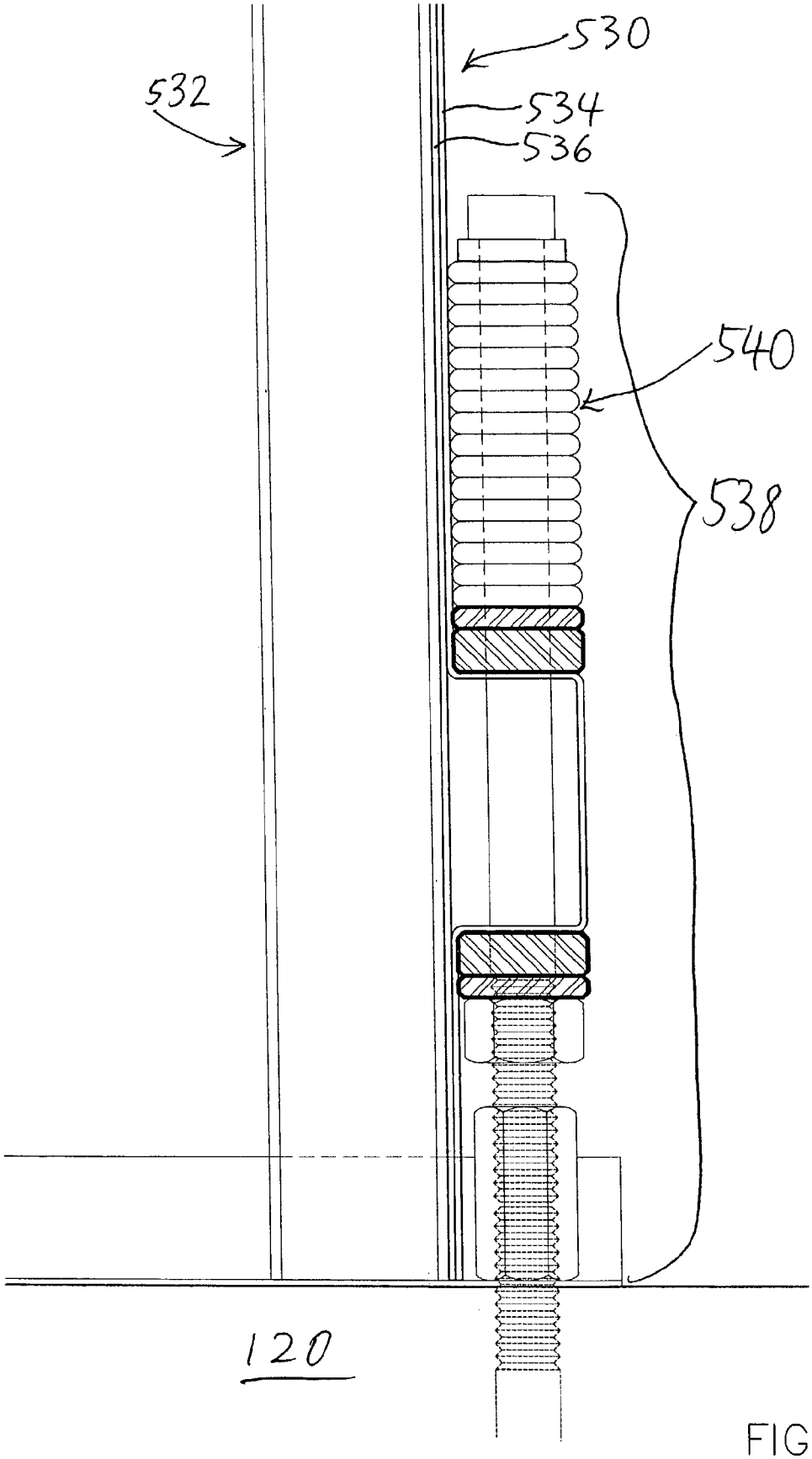
FIG. 11 illustrates a side view of the interconnecting arrangement of FIG. 10.

FIG. 11 illustrates a side view of the interconnection of the metal post 532 to the foundation 120 via the connecting assembly 538. As previously described and also shown in FIG. 10, inner and outer plates 536, 534 of the bracket 530 may be secured to each other by clinching. In certain embodiments, the inner and outer plates may also be joined by an adhesive adapted for structural application. Such adhesive joint may be reinforced by clinching. The bracket 530 in FIG. 11 may be secured to the metal post 532 by a plurality of fasteners, adhesive, or some combination thereof, in a manner similar to that described above in reference to FIG. 9.

Figure 12B:
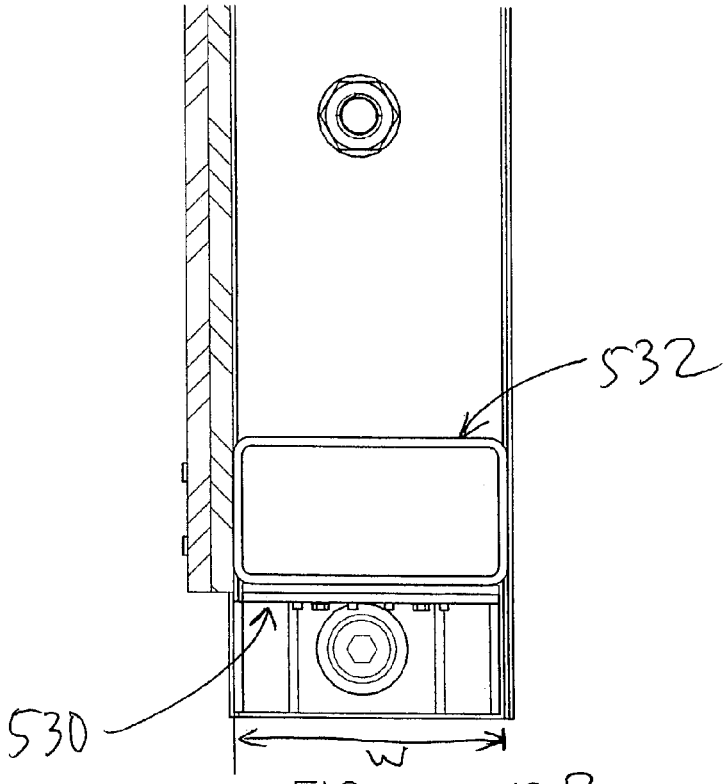
FIGS. 12A and B illustrate top views of the interconnecting arrangements of FIGS. 7 and 10, respectively.
Figure 12A:
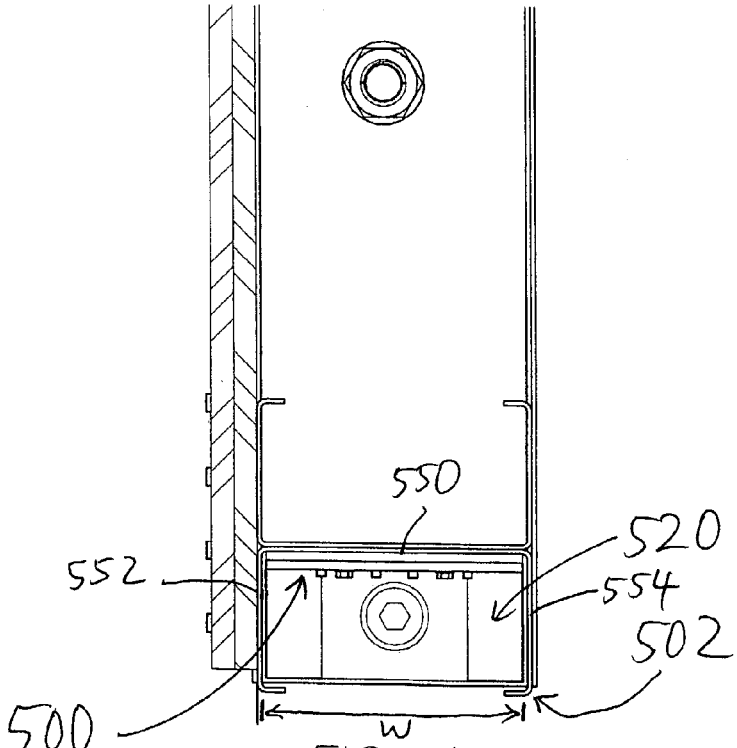

FIGS. 12A and B illustrate top views of the interconnecting arrangements for the metal posts 502 (via the bracket 500) and 532 (via the bracket 530). In certain embodiments, the lateral dimension "W" of the brackets (500 and 530) is selected to be compatible with posts having lateral dimensions similar to the wooden posts (typically 3½"). Thus for those brackets, the exemplary dimensions of the various parts as described above also applies here.

As seen if FIG. 12A, the recess 520 is defined by the "C" cross sectional shape of the metal post 502. The cross-sectional shape of the post comprises an interconnecting section 550 that interconnects a first section 552 to a second section 554 so as to form a "C" shape. The first and second sections 552 and 554 are typically parallel to each other, and the two sections 552 and 554 are generally perpendicular to the interconnecting section 550. Thus, the dimension of the recess 520 is determined by the dimensions of the two sections 552, 554, and the interconnecting section.

In certain embodiments, two such C-channels are joined back to back so as to form the double-C-channel configuration illustrated in FIG. 12A. Whether the metal post comprises a single-C-channel or a double-C-channel, the recess defined by the C-channel may be dimensioned so as to facilitated positioning of the bracket and the connecting assembly within the recess. FIG. 12A shows such configuration where the bracket 500 and the connecting assembly are positioned within the recess 520.

As described above, in certain embodiments, the joining of the inner and outer plate to each other, as well as joining of the bracket to the metal post, may be achieved in part by use of a structural adhesive. As is generally known, metal-to-metal structural bonding may be achieved by adhesives adapted for such use.

In certain embodiments, the various metal posts described above are formed from steel. In other embodiments, the metal posts are formed from other structurally applicable materials such as aluminum. It will be understood that the metal post may be formed from any metal without departing from the spirit of the present teachings.

It will be appreciated that in the application of the bracket with the metal posts, in particular the C-channel type posts, an added benefit is provided by the bracket disposed proximate the ends of a shear panel. Traditionally, a disadvantageous failure mode in a shear wall assembly using C-channel posts in a conventional manner is the buckling of the C-channels when loaded in compression. It will be appreciated that use of various embodiments of the brackets disclosed herein mitigates such buckling tendencies and reduces such failures.

Although the foregoing description of the embodiments of the invention has shown, described and pointed out the fundamental novel features of the invention, it will be understood that various omissions, substitutions and changes in the form of the detail of the apparatus as illustrated, as well as uses thereof, may be made by those skilled in the art without departing from the spirit of the invention. Consequently, the scope of the invention should not be limited to the foregoing discussion, but should be defined by the appended claims.

What is claimed is:

1. A device for transferring tension and compression forces incident on a metal vertical support of a building to an anchor bolt extending out of a foundation of the building, the device comprising:

an attachment member having at least one planar surface that is sized to be attached to the metal vertical support of the building wherein the attachment member includes a laterally extending section that extends outward from the planar surface; and a load piece that is attached to the attachment member, wherein the load piece includes a mounting section that defines a recess that receives the laterally extending section such that the laterally extending section reinforces the mounting section and wherein the mounting section has an upper and lower surface that are substantially perpendicular to planar surface, wherein the upper and lower surface include openings through which the anchor bolt extend such that the anchor bolt can be coupled to the load piece with the laterally extending section of the attachment member reinforcing the mounting section of the load piece.

2. The device of claim 1, wherein the attachment member is attached to the load piece via clinching.

3. The device of claim 1, wherein the attachment member is attached to the load piece via an adhesive.

4. The device of claim 1, wherein the attachment member is attached to the load piece via a combination of clinching and adhesive.

5. The device of claim 1, wherein the attachment member is attached to the metal vertical support by a plurality of fasteners.

6. The device of claim 5, wherein the fasteners comprise self-tapping metal screws.

7. The device of claim 1, wherein the attachment member is attached to the metal vertical support by an adhesive.

8. The device of claim 1, wherein the attachment member is attached to the metal vertical support by a combination of an adhesive and a plurality of fasteners.

9. The device of claim 1, wherein the metal vertical post support is formed from steel.

10. The device of claim 9, wherein the metal vertical support has a cross-sectional shape of a double-C-channel configuration comprising a back-to-back arrangement of two C-channels wherein each C-channel defines a recess within the "C" shape.

11. The device of claim 10, wherein the recess defined by the C-channel is dimensioned to allow positioning of the attachment member and the load piece substantially therein.

12. A device for transferring tension and compression forces incident on a metal vertical support of a building to an anchor bolt extending out of a foundation of the building, the device comprising:

an attachment member having a planar surface that is attachable to the metal vertical support of the building wherein the attachment member is shaped so as to define a reinforcing section that extends outward from the planar surface;

a mounting member that is attached to the attachment member, wherein the mounting member includes a planar surface and is shaped so as to define a mounting section that defines a recess which receives the reinforcing section of the attachment member wherein the mounting member includes openings so as to permit the anchor bolt to extend therethrough such that when the anchor bolt is mechanically coupled to the mounting section and the planar surface of the attachment member is attached to the metal vertical support of the building, tension and compression forces incident on the metal vertical support of the building can be transmitted to the anchor bolt.

13. The device of claim 12, wherein the attachment member is attached to the mounting member via clinching.

14. The device of claim 12, wherein the attachment member is attached to the mounting member via an adhesive.

15. The device of claim 12, wherein the attachment member is attached to the mounting member via a combination of clinching and adhesive.

16. The device of claim 12, wherein the attachment member is attached to the metal vertical support by a plurality of fasteners.

17. The device of claim 16, wherein the fasteners comprise self-tapping metal screws.

18. The device of claim 12, wherein the attachment member is attached to the metal vertical support by an adhesive.

19. The device of claim 12, wherein the attachment member is attached to the metal vertical support by a combination of an adhesive and a plurality of fasteners.

20. The device of claim 12, wherein the metal vertical support is formed from steel.

21. The device of claim 20, wherein the metal vertical support has a cross-sectional shape of a double-C-channel configuration comprising a back-to-back arrangement of two C-channels wherein each C-channel defines a recess within the "C" shape.

22. The device of claim 21, wherein the recess defined by the C-channel is dimensioned to allow positioning of the attachment member and the mounting member substantially therein.

* * * * *